United States Patent [19]

Joiret

[11] 4,043,842

[45] Aug. 23, 1977

[54] GRINDING MEMBERS

[76] Inventor: Victor L. J. Joiret, 115, rue de la Beole, Chaudfontaine, Belgium

[21] Appl. No.: 665,292

[22] Filed: Mar. 9, 1976

Related U.S. Application Data

[63] Continuation of Ser. No. 271,027, July 12, 1972, abandoned, which is a continuation-in-part of Ser. No. 32,802, April 29, 1970, abandoned, which is a continuation-in-part of Ser. No. 696,325, Jan. 8, 1968, abandoned, said Ser. No. 271,027, is a continuation-in-part of Ser. No. 178,822, Sept. 8, 1971, abandoned, which is a continuation of Ser. No. 696,325, , abandoned.

[51] Int. Cl.[2] ..... C22C 37/06; C21D 5/00

[52] U.S. Cl. ..... 148/35; 148/134; 148/138; 148/141

[58] Field of Search ..... 75/126 A, 123 CB; 148/31, 37, 35, 134, 138, 141

[56] References Cited

U.S. PATENT DOCUMENTS

| | | | |
|---|---|---|---|
| 1,245,552 | 11/1917 | Becket | 75/126 A |
| 2,201,425 | 5/1940 | Berglund | 75/126 A |
| 2,773,761 | 12/1956 | Fugua et al. | 75/126 A |
| 2,934,430 | 4/1960 | Klaybor et al. | 75/126 A |
| 3,334,996 | 8/1967 | Foster et al. | 148/35 |
| 3,410,682 | 11/1968 | Avery et al. | 75/128 D |
| 3,690,957 | 9/1972 | Thompson | 148/35 |
| 3,692,515 | 9/1972 | Fletcher et al. | 75/126 A |

FOREIGN PATENT DOCUMENTS

| | | | |
|---|---|---|---|
| 693,669 | 2/1967 | Belgium | 75/126 A |
| 6,800,375 | 7/1968 | Netherlands | 75/126 A |
| 438,179 | 11/1935 | United Kingdom | 75/126 R |

OTHER PUBLICATIONS

Transactions of ASM, June 1935, pp. 469–494.

Alloys of Fe and Cr; vol. II, Kinzel et al., 1940, pp. 157–165, 182, 183, 189, 190–195.

Norman et al., "Martensitic White Cast Irons for Abrasion–Resistant Castings," Trans Amer. Foundrymen's Soc., vol. 67, 1959 pp. 242 & 246–256.

*Primary Examiner*—Arthur J. Steiner

*Attorney, Agent, or Firm*—Holman & Stern

[57] ABSTRACT

Heat-treated cast grinding members such as grinding balls and lining plates for use in a grinding mill, which members are subjected to abrasion and repeated impacts are disclosed. The members have a composition of chromium and carbon within the quadrilateral diagram seen in FIG. 1 and have been subjected to a hardening heat-treatment from 950° to 1100° C and a tempering heat-treatment from 440° to 530° C. The members evidence the metallographic structure constituted by eutectic carbides and a matrix which matrix is free of pearlite and includes a martensitic solid solution containing less than 3% of residual austenite, and pro-eutectoidic carbides, the members having a Rockwell "C" of at least 59.

4 Claims, 4 Drawing Figures

GRINDING MEMBERS

This application is a Continuation of Ser. No. 271,027, filed July 12, 1972, now abandoned; which was a continuation-in-part application of U.S. Ser. No. 32,802, filed Apr. 29, 1970, now abandoned; which in turn was a continuation-in-part of U.S. Ser. No. 696,325, filed Jan. 8, 1968, now abandoned. U.S. Ser. No. 271,027 was also a continuation-in-part application of U.S. Ser. No. 178,822, filed Sept. 8, 1971, now abandoned; which in turn was a continuation of base-parent application U.S. Ser. No. 696,325, filed Jan. 8, 1968, now abandoned.

BACKGROUND OF THE INVENTION:

1. Field of the Invention

This invention relates to the field of steel alloys, more particularly chromium alloys, which are noted for their hardness and their ability to withstand abrasion and repeated impact shock loads. More specifically this invention relates to the manufacture of cast steel alloys particularly well suited for fabrication into elements which will be subjected to abrasion and repeated impacts. Accordingly, the general objects of the present invention are to provide novel and improved materials and methods of such character.

2. Description of the Prior Art

Grinding members of various compositions and characteristics are widely employed in industrial processes which involve the fragmentation of materials. These prior art grinding members are manufactured out of forged steel or are cast from pearlitic white iron, martesitic white iron or chromium-alloyed steels.

For most applications cast grinding members made of chromium-alloyed steels are more resistant to abrasion than are grinding members made of ordinary forged steel or of pearlitic white cast iron. Such chromium-alloyed steels are also more resistant to repeated impacts than members made of martensitic white cast iron.

Hitherto known chromium-alloyed steels used for the manufacture of grinding media have, in addition to iron, had the following average composition by weight:

1.5% to 3% of C
0.5% to 1.5% of Mn
1% of Si (maximum)
0.06% of S
0.06% of P
11% to 13% of Cr Additionally, these known steel alloys may contain up to 0.8% molybdenum and/or up to 0.7% nickel. In the case of balls intended for use in grinding mills, and depending on the size of the members formed therefrom, the characteristics of these known chromium-alloyed steels are as follows:

| | $\phi$ less than 50 mm | $\phi$ equal to or greater than 50mm |
|---|---|---|
| Rockwell C Hardness | 50 to 66 | 51 to 63 |
| Residual austenite content | 5% to 13% or more | 5% to 13% or more |

(where $\phi$ is the diameter of the balls tested).

As can be noted from the above table, the residual austenite content in the matrix of these known chromium-alloyed steels always exceeds 5% and increases with hardness at least in the range of relatively low austenite contents. In the table, the lower contents of residual austenite do always relate to the lower hardness, whereas with the increase of the hardness the residual austenite content tends toward the higher amounts indicated. However, as is known by those skilled in the art to which this invention pertains, while the resistance to abrasion of an alloy is enhanced as hardness increases, an increase in the residual austenite content in the matrix of the alloy results in a decrease in resistance to repeated impacts.

Grinding members manufactured from such hitherto known chromium-alloyed cast steels; although they are superior to the other above mentioned known grinding members, especially as regards their resistance to abrasion if these steels have been manufactured with a hardness in excess of 58 Rockwell C; generaly do not possess sufficient resistance to repeated impacts. This is particularly true for grinding members having diameters equal to or exceeding 50 mm. Such "large" diameter members are at present usually subjected to severe impact conditions. The lack of impact resistance results from the fact that for cast steel with Rockwell C hardness exceeding 58 the residual austenite content within the matrix remains too high (7% and over). Accordingly, under the action of impacts internal stresses are generated which can cause a premature destruction of the grinding members by breakage or spalling.

SUMMARY OF THE INVENTION:

The present invention overcomes the above-discussed and other deficiencies of the prior art by providing novel chromium alloy cast steels with selected chromium-carbon contents.

The alloys provided by the invention have good resistance to wear when subjected to abrasion and to repeated impacts due to a Rockwell C hardness of from 59 to 63 Rc, a metallographic structure constituted by a martensitic solid solution, free from pearlite, containing eutectic and pro-eutectoidic carbides, but containing less than 3% of residual austenite and characterized by the following chemical composition by weight:

the chromium and carbon contents being comprised within the range defined by a closed area of a chromium-carbon coordinate diagram having the following coordinates:

Cr = 7.5%; C = 1.5%
Cr = 27%; C = 1.5%
Cr = 35%; C = 2.5%
Cr = 27%; C = 3%
Cr = 15%; C = 3% the molybdenum content being not more than 2% the content of the elements vanadium, tungsten, niobium, titanium and tantalum being not more than 1% and the balance being substantially iron with the percentages of manganese, silicon, phosphorus and sulphur not exceeding those normally contained in commercial cast steel or iron.

The steel alloys of the invention are suitable for use in the manufacture of grinding members such as balls or lining plates for use in grinding mills or the like, particularly for percussion grinding.

The heat treating process for the alloys consists generally of a hardening operation in still or blast air during which the material is heated to a temperature ranging between 950° C up to a maximum of approximately 1200° C. The preferred hardening temperature varies according to specific percentages of chromium and carbon in the alloy.

The hardening step is followed by a tempering step in which the temperature ranges between 440° C to a maximum of approximately 570° C. As in the hardening step, the preferred tempering temperature also varies according to the carbon and chromium content.

It is, accordingly, an object of the present invention to provide chromium steel alloys which are particularly suited to use in crushing and grinding operations.

It is another object of the present invention to provide methods of heat treating chromium steel alloys to obtain selected hardness properties.

It is still a further object of the present invention to provide a heat treating process for steel alloys which produces low quantities of austenitic phase in the metallographic structure.

It is still a further object of the present invention to provide steel alloys having very low quantities of residual austenite in the metallographic structure and simultaneously having a Rockwell C of from 59 to 63 Rc.

It is one of the objects of the present invention to provide improved grinding members: particularly balls and lining plates for use in grinding mills.

It is a further object of the present invention to provide improved grinding members, particularly balls and lining plates for use in percussion grinding, which have improved wear resistance when subjected to abrasion and repeated impact stress.

Still a further object of the present invention is the provision of a cast steel for use in the manufacture of such grinding members.

It is an additional object of the present invention to provide a heat treating process for an alloy steel in which the hardening and tempering steps vary as a function of the amounts of chromium and carbon in the compositions.

The invention is further concerned with the heat treatment which is applied to cast steel alloys used in the manufacture of the grinding members.

BRIEF DESCRIPTION OF THE DRAWINGS:

The present invention with its numerous objects and advantages will be better understood by reference to the following drawings wherein.

DESCRIPTION OF THE PREFERRED EMBODIMENT

In accordance with a first embodiment of the present invention alloys particularly well suited for use in grinding members for grinding mills, and other environments and/or uses where superior resistance to wear when subjected to abrasion and to repeated impacts is required, are comprised of high chromium content cast steels having a metallographic structure characterized by a martensitic solid solution, without pearlite, containing less than 3% residual austenite, and of eutectic and pro-eutectoidic carbides.

These alloys, and balls and lining plates fabricated therefrom, are furthermore characterized by a hardness equal to or above 59 Rc on the Rockwell C scale.

The steels destined to the manufacture of balls or lining plates according to the said first embodiment of the invention will hereinafter be referred to as Type I alloys and present a composition defined as follows:

1. the Cr and C contents in percent by weight are defined by a quadrilateral, the coordinates of which are:

Cr = 22%; C = 2%
Cr = 27%; C = 3%
Cr = 14%; C = 2%
Cr = 19%; C = 3%

2. special elements other than chromium such as, for example, molybdenum, vanadium, tungsten, etc., though being not essential, may be present in small quantities in the interest of more easily achieving the desired metallurgical and physical properties.

3. other common elements, such as manganese, silicon, sulphur and phosphorus are not critical when not exceeding percentages generally found in non-alloyed cast steels.

These alloys, and balls and lining plates fabricated therefrom, are moreover characterized by the heat-treatment applied thereto.

Figure 1:
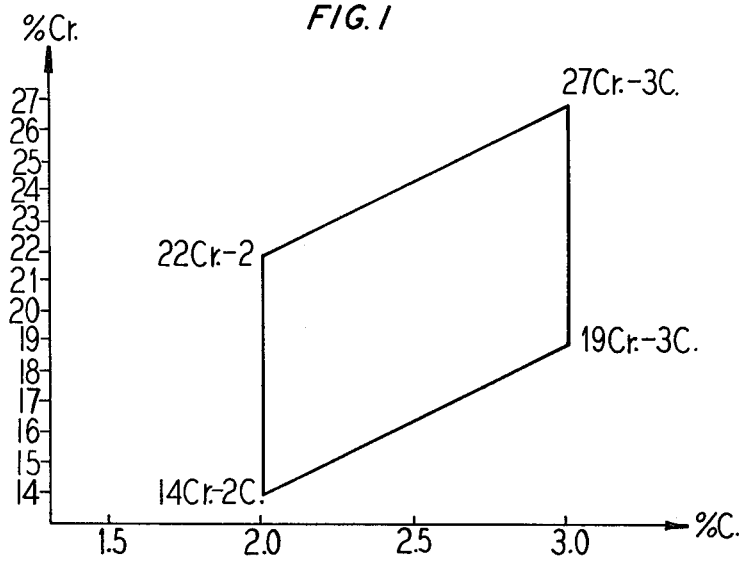
FIG. 1 is a diagram showing the boundaries of the chromium and carbon content of steel alloys in accordance with a preferred embodiment of the invention.

Thus a cast alloy steel according to the invention has a composition in which the chromium and carbon contents are selected from within the area defined by the above mentioned quadrilateral, which is depicted in FIG. 1, and in which the Si content is not greater than 1.5%, the Mn content not greater than 1.5%, the Mo content not greater than 2%, the contents of V, W, Nb, Ti and Ta not greater than 1% with the balance being Fe. Small amounts of Al may also be added to the cast to deoxidize the alloys.

The heat-treatments to which these Type I steels should be submitted in order to obtain the desired properties consist of hardening followed by tempering. For the hardening step, still or blast air hardening, in the temperature range of 950° C to 1100° C, is employed with the optimum temperature in this interval depending on the Cr and C contents and having to increase from the lower end of the temperature range in accordance with the expression:

$$\%Cr - 5 \times \%C$$

In this expression %Cr represents the percentage content of chromium and %C represents the percentage content of carbon in the steel.

The hardening temperature, the time of treatment at that temperature and cooling rate are adjusted with the object of insuring that after hardening the structure is devoid of pearlite and bainite and does not contain more than 20% of stabilized austenite.

When the value of the quantity $\%Cr - 5 \times \%C$ is small (i.e. 4%) a lower temperature (950° C) is used and this temperature increases linearly with $\%Cr - 5 \times \%C$ until the value of the quantity is 12%, when the temperature is 1100° C. The formula is:

$$\text{Temperature } (^\circ C) = 950^\circ C + [(\%Cr - 5 \times \%C - 4) \times 18.75.]$$

In this formula 4 is the minimum value for "$\%Cr - 5 \times \%C$" while:

$$18.75 = \frac{1100 - 950}{12 - 4} = \frac{150}{8} = \frac{\text{range of temperatures}}{\text{percent range}}$$

The time required for hardening is about 1 hour plus ¼hour for each inch of maximum thickness and the time of cooling to about 250° C should be less than half an hour.

Tempering is carried out at a temperature which is between 440° C and 530° C; the exact temperature in this range depending on the Cr and C contents and being greater with an increase in the value of the expression %Cr 31 5 × %C.

The preferred tempering temperature can be calculated in a similar manner to that given above, i.e.:

Temperature (° C) = 440° C + (%Cr − 5 × %C − 4) × 11.25° C

Again 4 is the minimum value of %Cr − 5 × %C while $$11.25 = \frac{530 - 440}{12 - 4} = \frac{90}{8}.$$

The above indicated formulas are valid for compositions without molybdenum or other special alloying elements.

If molybdenum and/or other alloying elements are included in the alloy the tempering temperature will have to be generally somewhat higher than those indicated above and will have to be adapted in accordance with the percentages of these elements in the alloy.

The tempering treatment is intended to transform the austenite stabilized during hardening. The tempering temperature and its time must be such that nearly all the stabilized austenite is transformed without the formation of pearlite; the formation of pearlite resulting in an unacceptable reduction in hardness. Furthermore, the quenched martensite is not deleteriously tempered. For some Type I steels, the austenite content after hardening may occasionally be somewhat above 20%. In this case, the almost complete transformation of the austenite stabilized during hardening is obtained by two successive temperings; the second tempering step being preferred at a temperature somewhat lower than the first step temperature. It has been found by trials that after such heat-treatment the properties obtained for Type I steels consistent with the invention are as follows:

Rockwell C Hardness: 59 to 63 Rc

Residual austenite content: less than 3%

Typical examples of Type I cast alloy steels according to the invention are as follows:

EXAMPLE I

In a first chamber of a clinker grinding mill having a diameter of 3.20 m the wear resistance to abrasion and repeated impact solicitations of four lots or sets of different grinding balls have been simultaneously tested during a period extending over 3034 hours. The lots comprised each one hundred balls which were marked individually per lot. The initial diameter of each grinding ball was 80 mm. The mill was charged with its usual amount of clinker.

The chemical compositions of the cast steel used for the manufacture of the balls of the four lots or sets were as follows:

First lot: C = 2.05%; Cr = 12.26%; Si = 0.44%; Mn = 0.52%

Second lot: C = 2.18%; Cr = 12.03%; Si = 0.42%; Mn = 0.44%

Third lot: C = 2.15%; Cr = 16.89; Si = 0.47%; Mn = 0.48%

Fourth lot: C = 2.16%; Cr = 17.46%; Si = 0.49%; Mn = 0.48% Mo = 0.68%

Apart from the above elements the steels contained small quantities of impurities and aluminum, the latter having been added to deoxidize the alloys. These quantities were as follows:

First lot: S = 0.057%; P = 0.049%; Al = 0.105%; balance = Fe

Second lot:S = 0.052%; P = 0.051%; Al = 0.092%; balance = Fe

Third lot: S = 0.055%; P = 0.052%; Al = 0.089%; balance = Fe

Fourth lot:S = 0.062%; P = 0.055%; Al = 0.094%; balance = Fe.

The heat treatment to which the balls were submitted were as follows:

First lot: hardening in oil at a temperature of about 850° C after having maintained the balls at this temperature for about 2 hours.

Second lot: hardening in oil at a temperature of about 915° C after having maintained the balls at this temperature for about 2 hours.

Third lot: hardening in blast air at a temperature of about 990° C after having maintained the balls at this temperature for about 2 hours and tempering at a temperature of about 465° C for about 2 hours.

Fourth lot: hardening in blast air at a temperature of about 1000° C after having maintained the balls at this temperature for about 2 hours and tempering at a temperature of about 490° C for about 2 hours.

The metallographic structure of the matrix after the heat treatment was:

For the balls of the first lot: martensite + 7% residual austenite.

For the balls of the second lot: martensite + 10% residual austenite.

For the balls of the third lot: martensite + 2.5% residual austenite.

For the balls of the fourth lot: martensite + 2% residual austenite.

The hardness measured were as follows:

First lot: 56 Rc

Second lot: 62 Rc

Third lot: 60.5 Rc

Fourth lot: 61 Rc The initial weight of the balls prior to the test was:

For the first lot: 2,047 gr ± 1 gr

For the second lot: 2,094 gr ± 1 gr

For the third lot: 2,057 gr ± 1 gr

For the fourth lot: 2,072 gr ± 1 gr

The wear on the balls measured in gram for one ball was:

For the first lot: 491 ± 21 gr

For the second lot: 477 ± 22 gr

For the third lot: 286 ± 14 gr

For the fourth lot: 254 ± 10 gr

EXAMPLE II

In a laboratory grinding mill having a diameter of 900 mm a series of tests was performed under harsher conditions than those encountered in industrial grinding mills. These conditions were created by running the mill without any charge thereby subjecting the test balls to repeated metal to metal impacts. In this series of tests only balls of the same chemical and physical characteristics were introduced to avoid any mutual influencing which may have affected the tests.

The balls tested were each of a diameter of 90 mm and for each test the mill was charged with 30 balls.

The balls employed in these tests were taken from the same cast and accordingly were all of identical chemical composition, which was the following:

C = 2.22%; Cr = 18.30%; Si = 0.52%
Mn = 0.44%; Mo = 0.03%; S = 0.065%
P = 0.059%; Al = 0.112%; balance = Fe The two lots were taken from the above cast and each lot was subjected to a different heat treatment prior to performing the tests:

Heat treatment for the first lot: hardening at a blast air at a temperature of about 990° C after having maintained the balls at this temperature for about 2 hours and tempering at about 455° C for about 2 hours.

Heat treatment for the second lot: hardening at blast air at a temperature of about 1010° C after having maintained the balls at this temperature for about 2 hours and tempering at about 475° for about 2 hours.

Due to the fact that the heat treatments of the first lot do not comply with the formulas given above, the metallographic structure of the matrix was:

First lot: martensite + 9% residual austenite
Second lot: martensite + 2.8% residual austenite The hardness for the balls of both lots was: 60 Rc The tests were carried out a time period of 1,000 hours.

The initial weight of each lot prior to the tests were:
For the balls of the first lot: 89.75 kg
For the balls of the second lot: 89.45 kg
After the tests the weight of each lot had reduced to:
For the balls of the first lot: 51.35 kg
For the balls of the second lot: 77.60 kg In accordance with a further embodiment of the invention the useful life of castings comprising the alloys of Type I may be prolonged. This result is accomplished by employing the chromium and carbon percentages as defined by the quadrilateral area represented in FIG. 2 by the following coordinates:

Cr = 31%; C = 2%
Cr = 35%; C = 2.5%
Cr 32 22%; C = 2%
Cr = 27%; C = 3%

With the exception of iron, the weight percentages of the other elements comprising these Type II alloys remains the same as for the Type I alloys.

Heat treatment specified for the indicated percentages of these Type II alloys consists, as for Type I alloys, in a hardening treatment and a tempering treatment. To determine the exact hardening temperature, it is convenient to divide the region enclosed with the quadrilateral shown in FIG. 2 into three zones. These zones are defined in the diagram by dot-dash lines with the following coordinates:

1. Cr = 28%; C = 2%; Cr = 33%; C = 2.63% and
2. Cr = 24%; C = 2%; Cr = 28.5%; C = 2.91%.

The most suitable hardening temperatures are those defined by the following formulas:

For Zone 1: 950° C+(%Cr−5×%C−4) 18.75° C.
This formula is identical to the one announced for Type I alloys.
For Zone 2: 1,137° C.
For Zone 3: 950° C+(%Cr−8×%C−1.5) 18.75° C.

All the temperatures obtained by these formulas are contained within the range between 1100° C and 1200° C.

The recommended tempering temperature for all the improved heavy-duty alloys of Type II is between 530° C and 560° C. As an example of the Type II alloy performance, the following data has been obtained.

EXAMPLE 3

In the same crusher or grinder, 90-mm diameter balls made from alloys with 27%Cr, 2.7%C, hardened from 1,130° C after having maintained the balls at this temperature for about 2 hours and tempered in two successive steps at a temperature of about 530° C for about 2 hours for each step, have been compared with balls of an alloy with 19%Cr, 2.5%C, hardened from 1,000° C after having maintained the balls at this temperature for about 2 hours and tempered at about 470° C for about 5 hours. Both alloys had, after heat treatment, a hardness value of 60 Rc (Rockwell C test) and less than 3% residual austenite in the matrix.

The balls of 27%Cr; 2.7%C composition had a rate of wear half that of the balls with 19%Cr; 2.5%C.

Figure 3:
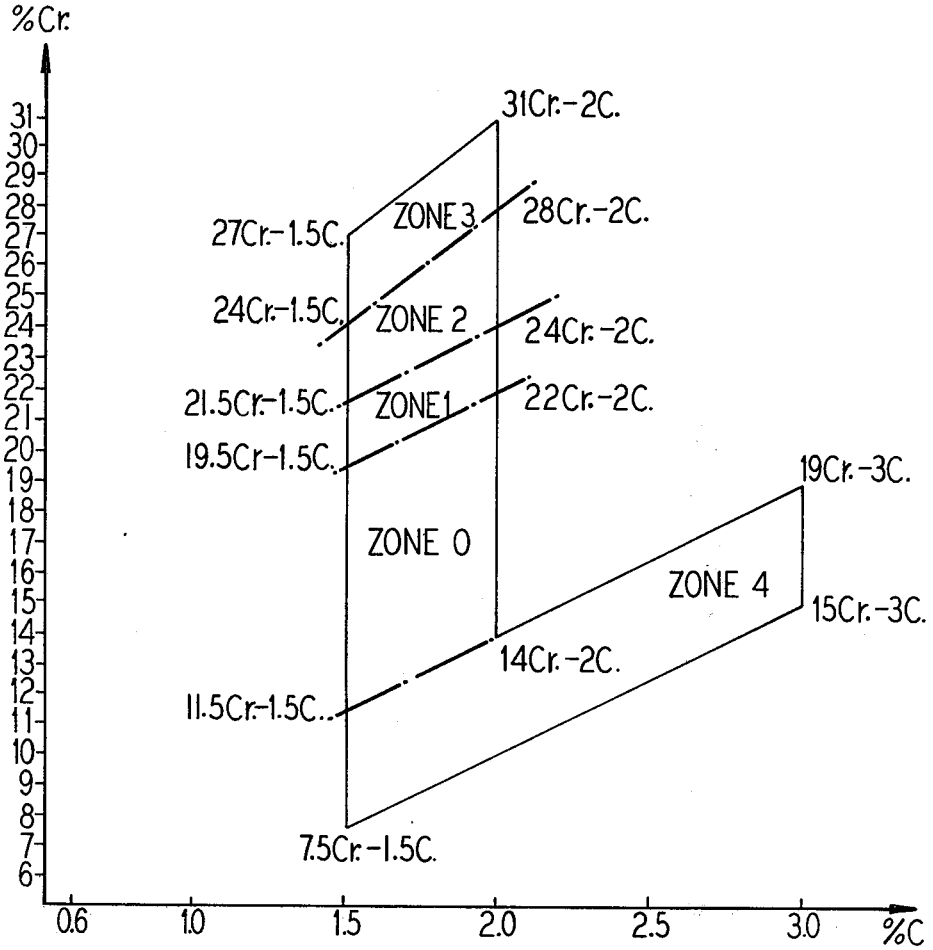
FIG. 3 is a diagram showing the boundaries of the chromium and carbon content of alloys in accordance with a third embodiment of the invention, the alloys of the third embodiment having generally smaller percentages of carbon or chromium than in the alloys represented in FIGS. 1 and 2.

On the other hand, it also has been found that for some particular applications less expensive castings made of compositions generally similar to those of Types I and II, but having carbon-chromium percentages as represented in FIG. 3 (Type III), are acceptable. These Type III alloys are characterized by the carbon exceeding a minimum of 1.5% by weight and have lower absolute performance than those described above. However, the Type III alloys may be more economical in use since their relative performance in certain applications is not reduced to the same extent as their cost. Of course the characteristics obtained by heat treatment should be comparable with regard to the hardness and maximum residual austenite content to the characteristics of the more expensive alloys. Heat treatments assuring such characteristics consist of hardening and tempering.

For Zones 1, 2 and 3 of the Type III alloys the most suitable hardening and tempering temperatures are identical with those of the corresponding zones in the more expensive Type II alloys. This is also true of the Zone 0 of Type III alloys which may be compared with Type I alloys. These temperatures are listed in the following table:

TABLE 1

| Zone | Hardening temperature | Tempering temperature |
|---|---|---|
| Zone 0 | 950° C + (%Cr − 5 × %C − 4) 18.75° C | 440° C + (%Cr − 5 × %C − 4) 11.25° C |
| Zone 1 | 950° C + (%Cr − 5 × %C − 4) 18.75° C | 530–560° C |
| Zone 2 | 1137° C | 530–560° C |
| Zone 3 | 950° C + (%Cr − 8 × %C − 1.5) 18.75° C | 530–560° C |

The hardening temperatures range from 950° C to 1200° C and the tempering temperatures range from 440° C to 560° C.

The characteristics obtained by these heat treatments are:

Hardness, Rockwell C: 58 to 62 Rc

Residual austenite: <3%

EXAMPLE 4

In the same crusher or grinder, balls of 90-mm diameter made of a first alloy with 19%Cr; 2.5%C, hardened at 1000° C and tempered at 470° C, have been compared with identical balls of a second alloy with 13%Cr; 1.6%C, hardened at 970° C and tempered at 450° C. The first alloy was heated treated to a hardness of 61 Rc while the second alloy was treated to a hardness of 60 Rc. Both alloys contained less than 3% residual austenite. The useful life of the first alloy was 10% longer than that of the second. Such a difference is, in general, from the economic standpoint insufficient to justify for numerous applications the greater costs involved in the production of the first alloy, so that the second alloy with its somewhat lower hardness usually fulfills the desired requirements.

For Zone 4 of the Type III alloys the hardening temperature must be within the range of 960° C to 1000° C and the tempering temperature must be fixed at 450° C ± 10° C. The characteristics obtained after this treatment are:

Hardness: 57 - 61 Rc
Residual austenite content: <5%

EXAMPLE 5

In the same mill, balls of 90-mm diameter made of an alloy containing 19%Cr and 2.5%C, hardened from 1000° C after having maintained the balls at this temperature for about 2 hours and tempered at 470° C for 4 hours, have been compared with balls of an alloy containing 12%Cr; 2.3%C, hardened at 980° C after having maintained the balls for about 2 hours at this temperature and tempered at 450° C for about 4 hours.

In the first case, a hardness of 61 Rc was obtained and a residual austenite content below 3%, whereas the second alloy was heat-treated to a hardness of 59 Rc and a residual austenite content of 4%. The useful life of the first alloy was 15% better than the useful life of the second. This divergence might in certain cases by insufficient to justify the difference in initial cost of production so that the alloys of zone 4 of Type III can advantageously be employed for a great number of application, since in any case these alloys exhibit improved wear resistance properties as compared to the hitherto known high chromium-carbon alloys.

Figure 2:
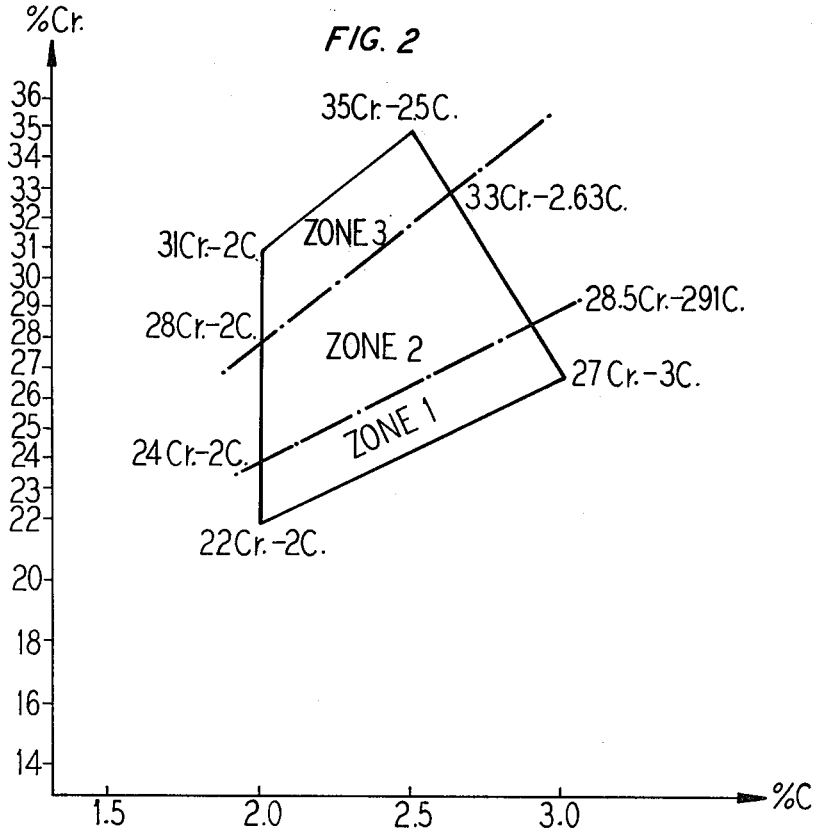
FIG. 2 is a diagram showing the boundaries of the chromium and carbon content of alloys in accordance with a second embodiment of the invention, the alloys of the second embodiment having slightly higher chromium content than the alloys represented in FIG. 1.

For pieces other than grinding elements such as balls and, in particular, for pieces having a relatively small thickness, as may be the case for lining plates, the breaking strength may be insufficient where heavy impact stresses can be expected. In such cases, it is necessary to choose an alloy with more suitable mechanical strength properties, although the wear resistance properties will become somwhat less. The corresponding chromium-carbon relationship is shown in FIGS. 1 to 3. The heat treatment to be used in such alloys is given by the following table:

The hardening temperatures range from 950° C to 1200° C and the tempering temperatures from 460° C to 570° C.

The characteristics obtained by such treatments are:

Rockwell C hardness: 52 - 59 Rc
Residual austenite: <2%

EXAMPLE 6

In the same crusher or grinder, lining plates of 30-mm thickness, made of a Type I alloy with 19%Cr and 2.5%C, hardened at 1000° C and tempered at 470° C, have been compared with similar plates comprised of a Type III alloy consisting of 13%Cr and 1.6%C, hardened at 970° C and tempered at 470° C. The Type I alloy castings were treated to a hardness of 61 Rc and 2.5% residual austenite; the Type III alloy castings to 55 Rc hardness and less than 1% residual austenite. The Type I alloy castings (19%Cr; 2.5%C) were removed prematurely from the crusher because of a fracture failure. The castings of alloy 13%Cr; 1.6%C gave complete satisfaction.

Figure 4:
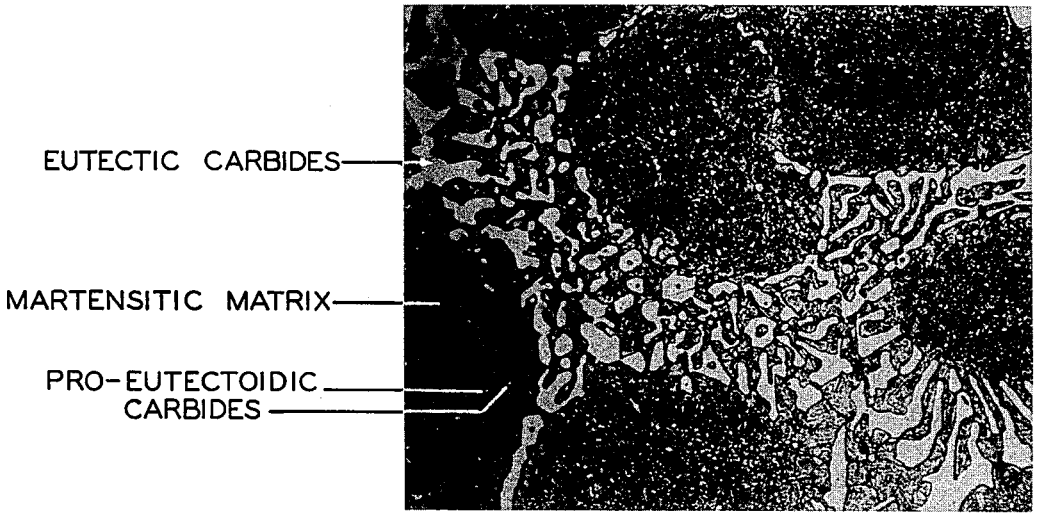
FIG. 4 is a micrograph showing the metallographic structure of a cast steel alloy in accordance with the invention.

The micrography of an alloy (17%Cr and 2.2%C) shown in FIG. 4 is an enlargement by 1200x of a cut polished with alumina and etched with nitol 3%. This micrography shows the metallographic structure constituted by a matensitic matrix, without pearlite, containing eutectic and pro-eutectoidic carbides. For the quantitative determination of the residual austenite in the martensitic structure the X-ray method known as the "Direct Comparison Method" has been adopted. According to this method the integrated intensity of a diffraction line from the austenite is compared with the integrated intensity of a martensite/ferrite line in terms of the fundamental intensities theoretically predicted for (hkl) lines of each phase. This method is briefly outlined below:

The intensity diffracted by a single phase specimen in a diffractometer may be expressed as:

$$I_{hkl} = \left(\frac{I_o e^4}{m^2 c^4}\right)\left(\frac{\lambda^3 A}{32\pi r}\right)\left(\frac{1}{V2}\right)\left[(F)^2 p\left(\frac{1+\cos^2 2\theta}{\sin^2\theta\cos\theta}\right)\right]\left(\frac{e^{-2M}}{2p}\right)(A)$$

where:

$I_{hkl}$ = integrated intensity per unit length of diffraction line.
$I_o$ = intensity of incident beam.
$e,m$ = charge and mass of electron
$c$ = velocity of light
$\lambda$ = wavelength of incident radiation
$A$ = cross-sectional area of incident beam
$V$ = volume of unit cell
$F$ = structure factor
$p$ = multiplicity factor
$O$ = Bragg angle
$_e-2M$ = temperature factor

TABLE II

| Zone | Hardening temperature | Tempering temperature |
|---|---|---|
| Zone 0 | 950° C + (%Cr − 5 × %C − 4) 18.75° C | 460° C + (%Cr − 5 × %C − 4) 11.25° C |
| Zone 1 | 950° C + (%Cr − 5 × %C − 4) 18.75° C | 550-570° C |
| Zone 2 | 1137° C | 550-570° C |
| Zone 3 | 950° C + (%Cr − 8 × %C − 1.5) 18.75° C | 550-570° C |
| Zone 4 | 960-1000° C | 470 + 10° C |

$\mu$ = linear absorption coefficient

The equation can be applied to a specimen, either a powder compact, or a solid, which contains a completely random arrangement of crystals, and is effectively of infinite thickness. Equation (1) can be rewritten as:

$$I = \frac{KR}{2\mu} \tag{2}$$

$$\text{where } K = \left(\frac{I_o e^4}{m^2 c^4}\right)\left(\frac{\lambda^3 A}{32\pi r}\right) \tag{3}$$

$$\text{and} \quad R = \left(\frac{1}{V^2}\right)\left[(F)^2 p\left(\frac{1+\cos^2 2\theta}{\sin^2\theta\cos\theta}\right)\right](e^{-2m}) \tag{4}$$

K is now a constant which is independent of the nature of the specimen while R is a factor which depends on $\theta$, the reflecting set pf planes and the crystal structure of the specimen.

Thus, in a mixture of two phases, ferrite/martensite ($\alpha$) and austenite ($\gamma$).

$$I_{\alpha hkl} = \frac{KR_{\alpha hkl} C_\alpha}{2\mu m} \tag{5}$$

where $C\alpha$ is the volume fraction of the $\alpha$ phase, $I_{\alpha hkl}$ is the measured integrated intensity, and $\mu m$ is the linear absorption coefficient of the mixture. Since there will be a similar expression for $I_{\gamma hkl}$, it follows that:

$$\frac{I_{\alpha hkl}}{I_{\gamma hkl}} = \frac{R_{\alpha hkl} C_\alpha}{R_{\gamma hkl} C_\gamma} \tag{6}$$

$$i.e. \frac{C_\gamma}{C_\alpha} = \frac{I_{\gamma hkl}. R_{\alpha hkl}}{I_{\alpha hkl}. R_{\gamma hkl}}$$

Hence, by obtaining the integrated intensities of a diffraction line from each phase, $C\gamma/C\alpha$ is obtained, and since $C\gamma + C\alpha = 1$, (whereby a correction for carbide content has to be made by means of a quantitative metallographic point counting).

It would thus theoretically have been sufficient to determine the intensity of one single pair of incident beams $\alpha,\gamma$ to obtain the ratio ($C\gamma/C\alpha$). This would, however, postulate that the measurements be made on perfectly isotrope samples. Therefore formula (6) should be replaced by the following formula $$\frac{C_\gamma}{C_\alpha} = \frac{\frac{1}{n_\gamma}\Sigma_o^{n\gamma}\left(\frac{I_\gamma}{R_\gamma}\right)}{\frac{1}{n_\alpha}\Sigma_o^{n\alpha}\left(\frac{I_\alpha}{R_\alpha}\right)} \tag{9}$$

where: $n_\alpha$ and $n_\gamma$ are the number of the $\alpha$ and $\gamma$ diffraction lines analyzed.

The results of the measurements made on the microstructure shown in FIG. 4 are given in Table III.

TABLE III

| | | | |
|---|---|---|---|
| $\frac{I_{1\gamma}}{R_{1\gamma}} = 2.061$ | $\frac{I_{2\gamma}}{R_{2\gamma}} = 1.989$ | $\frac{I_{1\alpha}}{R_{1\alpha}} = 90.26$ | $\frac{I_{2\alpha}}{R_{2\alpha}} = 90.35$ |
| $\frac{C_\gamma}{C_\alpha} = \frac{2.061 + 1.989}{90.26 + 90.35} = \frac{4.050}{180.61} = 0.0224$ | | $C_\alpha = \frac{C_\gamma}{0.0224}$ | |
| % Carbides: 22% $C_\alpha + C_\gamma = 78\% \doteq 0.78$ | | | |
| $C_\gamma = 0.78 = \frac{C_\gamma}{0.0224}$ | $C_\gamma = \frac{0.78 \times 0.0224}{1 + 0.0224} = 0.0170 = 1.70\%$ | | |

From this table, it can be seen that the alloy had a residual austenite content of about 1.70%, that the martensitic structure was about 76.30% and the eutectic and pro-eutectoidic carbides totaled to about 22%.

While generally preferred forms of the present invention have been described above in regard to the hardening, tempering temperatures and times, it must be understood that such temperatures and times are given by way of example and serve as guides for those skilled in the art. The temperatures and times may be adjusted as required according to the size of the casting and other conditions of the treating furnace. Accordingly, the present invention has been described by way of illustration rather than limitation.

What is claimed is:

1. Heat-treated cast grinding members for use in a grinding mill, wherein said members are subjected to abrasion and repeated impacts, which members are made of a casting consisting essentially in weight percentage of chromium and carbon limited to a range defined by a closed area of a chromium-carbon coordinate diagram having the following coordinates:

Cr = 22%; C = 2%
Cr = 27%; C = 3%
Cr = 14%; C = 2%
Cr = 19%; C = 3% the balance being essentially iron with the usual impurities; said casting having been subjected to a hardening heat-treatment from a temperature between 950° C to 1100° C, the temperature for hardening increasing within the range in accordance with the following relationship: %Cr − 5 × %C, and subsequently to a tempering heat-treatment at a temperature between 440° C and 530° C, the temperature for tempering increasing within the range in accordance with the following relationship: %Cr − 5 × %C, in such a manner as to evidence a metallographic structure constituted by eutectic carbides and a matrix, which matrix is free of pearlite and includes a martensitic solid solution containing less than 3% of residual austenite, and pro-eutectoidic carbides, said heat-treated casting having a Rockwell C hardness of at least 59.

2. Heat-treated cast grinding members as claimed in claim 1 further including at least one ingredient selected from the group consisting of, in weight percent:

molybdenum from 0–2%,
vanadium, tungsten, niobium, titanium and/or tantalum from 0–1%, and silicon and/or manganese from 0.25–1.5%.

3. Heat-treated cast grinding members as claimed in claim 1 wherein said grinding members are grinding balls.

4. Heat-treated cast grinding members as claimed in claim 1 wherein said grinding members are lining plates for grinding mills.

* * * * *